US005690505A

United States Patent [19]

Hirata

[11] Patent Number: 5,690,505

[45] Date of Patent: Nov. 25, 1997

[54] PRESSURE JOINT CONNECTOR AND METHOD OF ASSEMBLING WIRE HARNESS USING THE SAME

[75] Inventor: Noboru Hirata, Hiroshima, Japan

[73] Assignee: Yazaki Corporation, Tokyo, Japan

[21] Appl. No.: 675,045

[22] Filed: Jul. 3, 1996

[30] Foreign Application Priority Data

Jul. 4, 1995 [JP] Japan ..... HEI.7-168801

[51] Int. Cl.[6] ..... H01R 4/24

[52] U.S. Cl. ..... 439/402; 439/410

[58] Field of Search ..... 439/402, 403, 439/409, 410

[56] References Cited

U.S. PATENT DOCUMENTS 5,435,747 7/1995 Framcky et al. ..... 439/409
5,494,455 2/1996 Shindon et al. ..... 439/402
5,562,478 10/1996 Yamamoto ..... 439/402

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

A pressure joint connector that joints a trunk line to a branch line. In the connector, an opening is formed in a housing, the opening causing the trunk line and the branch line inserted into the housing to be exposed. A primary cover is arranged on the housing, so that when the primary cover closes the opening, the primary cover fixes only the branch line and does not fix the trunk line. A secondary cover is arranged on the housing, the secondary cover being closed so as to be superimposed on the primary cover that has already closed the opening. Pressure blades are arranged so as to project from the secondary cover. The pressure blades force-fit both the trunk line and the branch line simultaneously by passing through the primary cover when the secondary cover is closed so as to be superimposed on the primary cover.

5 Claims, 3 Drawing Sheets

PRESSURE JOINT CONNECTOR AND METHOD OF ASSEMBLING WIRE HARNESS USING THE SAME

BACKGROUND OF THE INVENTION

The invention relates to a pressure joint connector that joints a trunk line to a branch line.

For automotive wiring, wire harnesses in which branch lines are branched from a trunk line are often employed in order to connect a plurality of electronic components. In this case, the trunk and branch lines having predetermined dimensions are prepared. FIG. 5 is a diagram illustrative of dimensional relationships of a wire harness having a branch line; FIG. 6 is a view illustrative of a joint portion of the branch line; and FIG. 7 is a perspective view showing a crimped joint portion. A wire harness 3 having a branch line 1 is prepared so that a dimension A between connectors 7 and 9 attached to both ends of a trunk line 5 and a dimension B between the connector 7 at one end of the trunk line and a connector 11 at a terminal end of the branch line are predefined.

In this case, the dimension A of the trunk line 5 is given by the cut length of the trunk line 5. On the other hand, the dimension B between the connector 7 at one end of the trunk line and the connector 11 at the terminal end of the branch line is given by the cut length of the branch line 1 and by making a joint positioning dimension C between the branch line 1 and the trunk line 5 as predefined. The trunk line 5 is jointed to the branch line 1, e.g., by cutting an insulating sheath at a predetermined midpoint of the trunk line 5 to expose conductors 5*a* and by crimping conductors 1*a* at the end portion of the branch line 1 to the conductors 5*a* using a crimp-type terminal 13.

Further, the trunk line is also jointed to the branch line by using a pressure joint connector 15 shown in FIG. 8 instead of using the crimp-type terminal 13. The pressure joint connector 15 has two electrically conducting pressure blades 19 and 21 inside a boxlike housing 17 that has an opening formed on the top thereof. Each of the pressure blades 19 and 21 has a U-shaped slot 23 that has an opening formed on the top thereof. On the other hand, the housing 17 has a cover portion 25 that can be freely opened and closed. The cover portion 25 has a projected portion 27 for pressing the trunk line 5 and the branch line 1 into the pressure blades 19 and 21 respectively.

The branch portion is jointed using this pressure joint connector 15 in the following way. The pressure joint connector 15 is positioned at a predetermined midpoint of the trunk line 5, which is a branching position; a terminal of the branch line 1 cut to a predetermined length is held within the pressure joint connector 15; and by closing the cover portion 25, the trunk line 5 and the branch line 1 are pressed into the slots 23 by the projected portion 27 to thereby simultaneously bring the trunk line 5 and the branch line 1 into pressure contact with the pressure blades 19 and 21 that are integrally disposed.

However, the jointing operation using the crimp-type terminal 13 shown in FIG. 7 can give the dimension A with the cut length of the trunk line 5, but in order to give the dimension B, both the joint positioning dimension C to the trunk line 5 and the total cut length of the branch line 1 must be satisfied. This entails an additional labor of positioning, thereby not only making the operation cumbersome, but also making dimensional error easy to occur.

Further, even in the case where the pressure joint connector 15 shown in FIG. 8 is used, the pressuring operation must be performed similarly with the joint positioning dimension C and the total cut length of the branch line 1 satisfied. That is, the dimension B of the branch line 1 cannot be given if any one of the dimension C and the total cut length is erroneous. In the case where the pressure joint connector 15 is used, the joint positioning, the holding of the trunk line 5 and the branch line 1 to the pressure joint connector 15, and the bringing of the trunk line 5 and the branch line 1 into pressure contact with the pressure blades must be performed simultaneously, in turn requiring dedicated processes and jigs and making dimensional correction after the pressure contact impossible.

Still further, in a wire harness having the branch line 1, U-shaped support jigs 29 such as shown in FIG. 9 are generally arranged at predetermined positions, and the wire harness is assembled by allowing the connectors 7, 9 and 11 of the wire harness to be rested on the support jigs 29. However, if such support jigs 29 are used for assembly, the jointing operation of the pressure joint connector 15 by moving the branch line 1 in a direction D becomes extremely difficult because such an operation entails both the positioning and the holding of the lines at the same time.

SUMMARY OF THE INVENTION

The invention has been made in view of the aforementioned circumstances. An object of the invention is therefore to not only provide a pressure joint connector that allows high dimensional accuracy to be obtained with a simple operation without requiring the positioning of a joint portion, but also improve the operability and guarantee the dimensional accuracy.

To achieve the above object, an aspect of the invention provides a pressure joint connector for jointing a trunk line to a branch line, comprising: a housing for allowing the trunk line and the branch line to be inserted thereinto, the housing having an opening formed thereon for exposing the trunk line and the branch line; a primary cover, arranged on the housing so as to be freely opened and closed through a hinge portion, for fixing only the branch line and leaving the trunk line unfixed when closed over the opening; a secondary cover, arranged on the housing so as to be freely opened and closed through a hinge portion, for closing so as to be superimposed on the primary cover already closed over the opening; and a pressure blade, arranged so as to project from the secondary cover, for coming in pressure contact with the trunk line and the branch line simultaneously by passing through the primary cover when the secondary cover is closed so as to be superimposed on the primary cover.

Another aspect of the invention provides a method of assembling a wire harness having a trunk line and a branch line, comprising the steps of: stretching the trunk line of a predetermined length by causing connectors to be rested on a first U-shaped jig and a second U-shaped jig, the connectors being attached to both ends of the trunk line respectively; causing a connector to be rested on a third U-shaped jig, the connector attached to one end of the branch line of a predetermined length; temporarily retaining a pressure joint connector having the other end of the branch line fixed so as to be slidable to an arbitrary position of the trunk line using the pressure joint connector for fixing the branch line and leaving the trunk line unfixed; pulling the branch line while causing the pressure joint connector to slide along the trunk line; and simultaneously bringing the trunk line and the branch line into pressure contact with a pressure blade of the pressure joint connector with the branch line stretched.

DETAILED DESCRIPTION OF THE PREFERRED EMBODIMENTS

A pressure joint connector, which is a preferred embodiment of the invention, will now be described with reference to the drawings.

Figure 1:
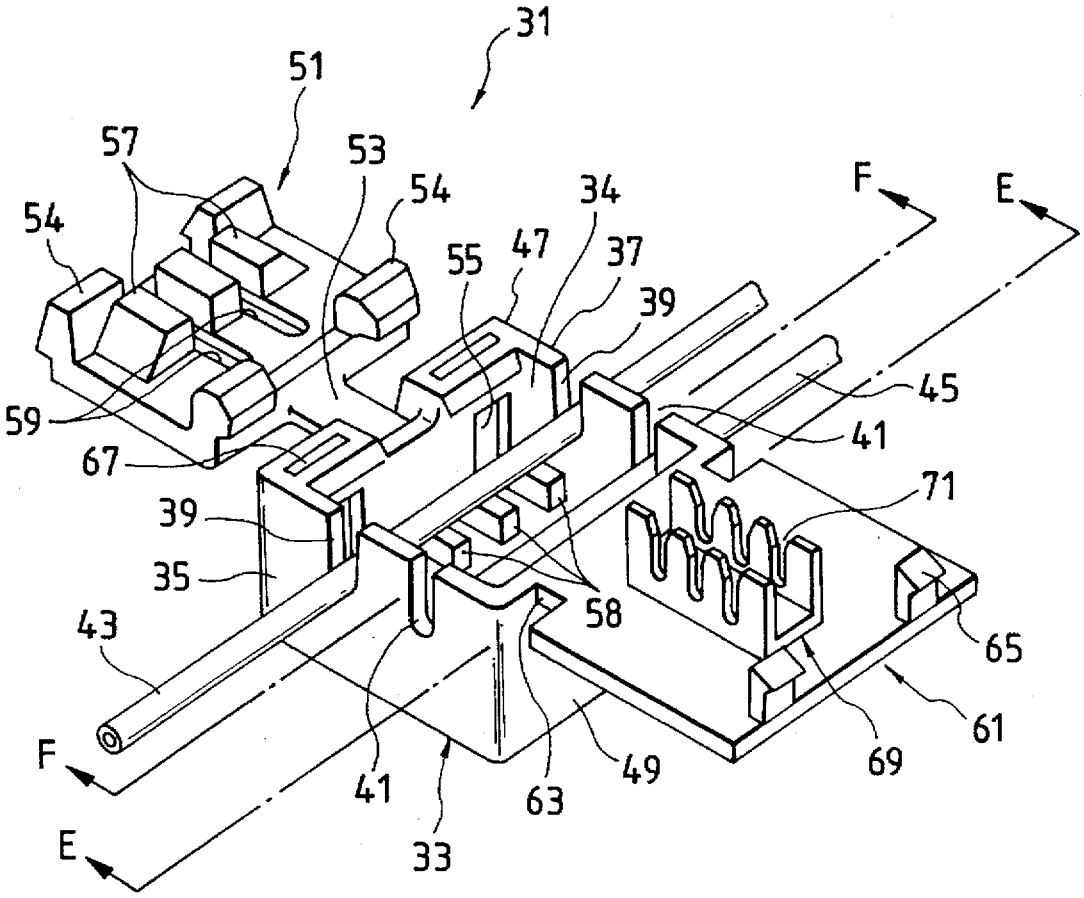
FIG. 1 is a perspective view showing a pressure joint connector of the invention.
Figure 2:
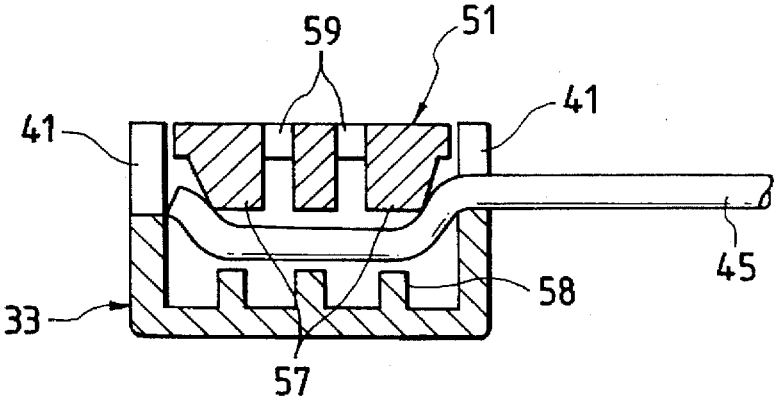
FIG. 2 is a sectional view taken along a line E—E of FIG. 1.

FIG. 1 is a perspective view of the pressure joint connector of the invention; FIG. 2 is a sectional view taken along a line E—E of FIG. 1; and FIG. 3 is a sectional view taken along a line F—F of FIG. 1.

A housing 33 of a pressure joint connector 31 has a hexahedral boxlike shape with the top thereof formed into an opening 34. Two sets of line inserting grooves 39 and 41 are formed in parallelly confronting wall surfaces (a front wall 35 and a rear wall 37) of the housing 33. The line inserting grooves 39 and 41, which are notched in U shape and confront each other. A trunk line 43 is inserted into one of the two sets of line inserting grooves 39 and 41, whereas a branch line 45 is inserted into the other of the two. It is noted here that the line inserting grooves 41 into which the branch line 45 is inserted may be formed only in the rear wall 37 of the housing 33.

A primary cover 51 is arranged on one 47 of two side walls 47 and 49 that are interposed between the front wall 35 and the rear wall 37 of the housing 33, through a hinge portion 53 so that the primary cover 51 can be freely opened and closed. The primary cover 51 is put over the opening 34 while turned through the hinge portion 53. Male retaining portions 54 are arranged at the four corners of the primary cover 51. The male retaining portions 54 project from the closing surface and are retained in recessed female retaining portions 55 formed at the four corners on the inner surface of the housing 33. Further, line pressing portions 57 are formed so as to project from the closing surface of the primary cover 51. The line pressing portions 57 press only the branch line 45 inserted into the line inserting grooves 41 when the primary cover 51 is put over the opening 34 as shown in FIG. 2.

Figure 3:
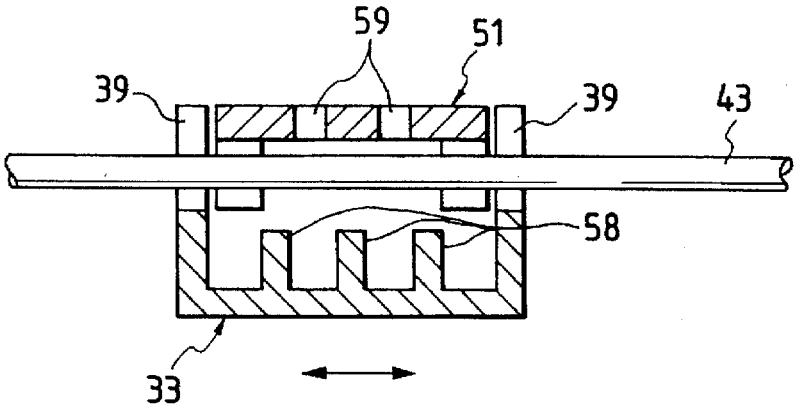
FIG. 3 is a sectional view taken along a line F—F of FIG. 1.

Therefore, with the primary cover 51 closed, only the branch line 45 is fixed to the housing 33, and the trunk line 43 is left unfixed as shown in FIG. 3. That is, under this condition the pressure joint connector 31 in which the terminal of the branch line 45 is fixed is freely movable over the trunk line 43. Further, support projections 58 extend under the trunk line 43 inserted into the line inserting grooves 39 and the branch line 45 inserted into the line inserting grooves 41. The support projections 58 project from the bottom surface of the housing 33. The support projections 58 are arranged so as to be orthogonal to the trunk line 43 and the branch line 45 at an interval: e.g., three support projections 58 are juxtaposed toward the trunk line 43 and the branch line 45. As shown in FIG. 3, the support projections 58 are not in contact with the trunk line 43 with the primary cover 51 closed.

Furthermore, a pair of through slits 59 is arranged in the primary cover 51. The through slits 59 are formed above the trunk line 43 and the branch line 45 arranged within the housing 33 so as to extend orthogonal to these lines.

On the other hand, a secondary cover 61 is arranged on the side wall 49 through a hinge portion 63 so that the secondary cover 61 can be freely opened and closed. The secondary cover 61 is designed to be closed so as to overlap on the primary cover 51 that is closed over the opening 34 of the housing 33. Male retaining portions 65 are arranged so as to project from the closing surface of the secondary cover 61. The male retaining portions 65 are engageable with female retaining portions 67 arranged on the outer peripheral side of the housing 33. Further, a pair of parallelly extending platelike pressure blades 69 is erected on the closing surface of the secondary cover 61 so as to extend orthogonal to the trunk line 43 and the branch line 45. The pressure blades 69 have two sets of U-shaped slots 71, the two sets of slots confronting each other.

The pressure blades 69 are designed to be inserted into the through slits 59 formed in the primary cover 51 when the secondary cover 61 is closed. That is, the pressure blades 69 come in pressure contact with the trunk line 43 and the branch line 45 arranged within the housing 33 by passing through the through slits 59. The trunk line 43, while supported by the support projections 58 from below, is force-fit into the depth of the corresponding slots 71 by the pressure blades 69 that are inserted from above. Further, the branch line 45 is force-fit into the depth of the corresponding slots 71 of the pressure blades 69 while interposed between the support projections 58 and the line pressing portions 57. The trunk line 43 and the branch line 45 that are pressured to the pressure blades 69 establish electrical conduction through the pressure blades 69.

Figure 4:
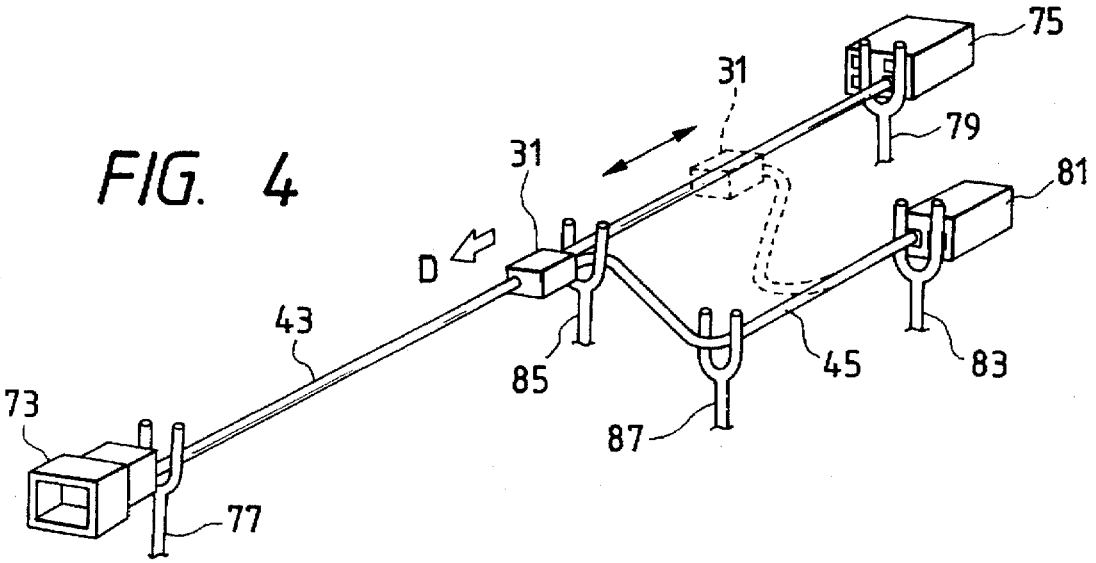
FIG. 4 is a diagram illustrative of a method of assembling the pressure joint connector of the invention using U-shaped jigs.

A procedure for assembling a wire harness having the branch line 45 using the thus constructed pressure joint connector 31 will be described. FIG. 4 is a diagram describing an assembling method using U-shaped jigs.

A wire harness is usually assembled using the U-shaped jigs shown in FIG. 4. The trunk line 43 is cut to a predetermined length and has connectors 73 and 75 attached to both ends thereof. The trunk line 43 having the connectors 73 and 75 is stretched between a first U-shaped jig (U-shaped jig) 77 and a second U-shaped jig (U-shaped jig) 79 while allowing the connectors 73 and 75 to be rested on the respective U-shaped jigs. Further, the branch line 45 is cut to a predetermined length and has a connector 81 attached to one end thereof. The connector 81 is rested on a third U-shaped jig (U-shaped jig) 83.

Under this condition the trunk line 43 and the other end of the branch line 45 are temporarily retained at an arbitrary position of the trunk line 43 using the pressure joint connector 31. This temporarily retaining operation is performed not only by inserting the trunk line 43 into the line inserting grooves 39 for the trunk line 43 of the pressure joint connector 31 at the arbitrary position of the trunk line 43, but also by inserting the other end of the branch line 45 into the line inserting grooves 41 for the branch line 45 of the pressure joint connector 31 and closing and fixing the primary cover 51. As a result, the other end of the branch line 45 is fixed to the pressure joint connector 31 by the line pressing portions 57, while the trunk line 43 becomes slidable with respect to the pressure joint connector 31 as shown in FIG. 3. That is, the pressure joint connector 31 with the branch line 45 fixed thereto is slidable to arbitrary positions on the trunk line 43 (see the condition shown by the broken lines in FIG. 4).

Figure 5:
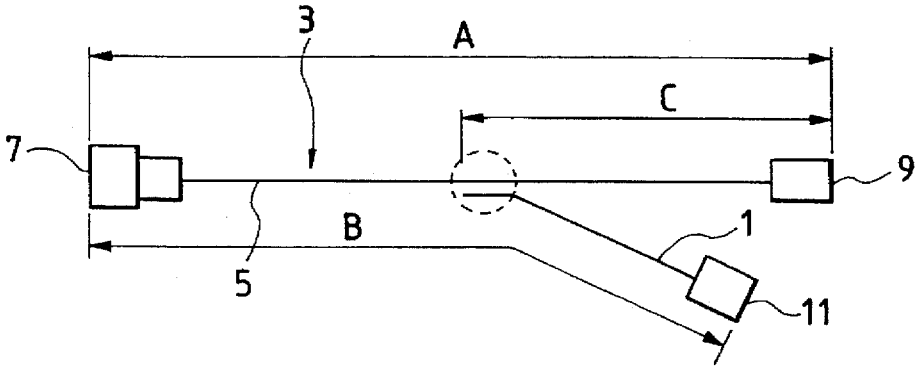
FIG. 5 is a diagram illustrative of dimensional relationships of a wire harness having a branch line.
Figure 6:
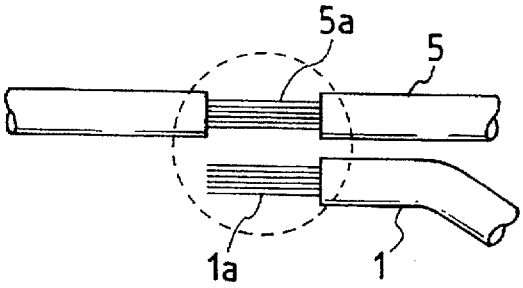
FIG. 6 PRIOR ART
FIG. 6 is a view illustrative of a joint portion of the branch line.
Figure 8:
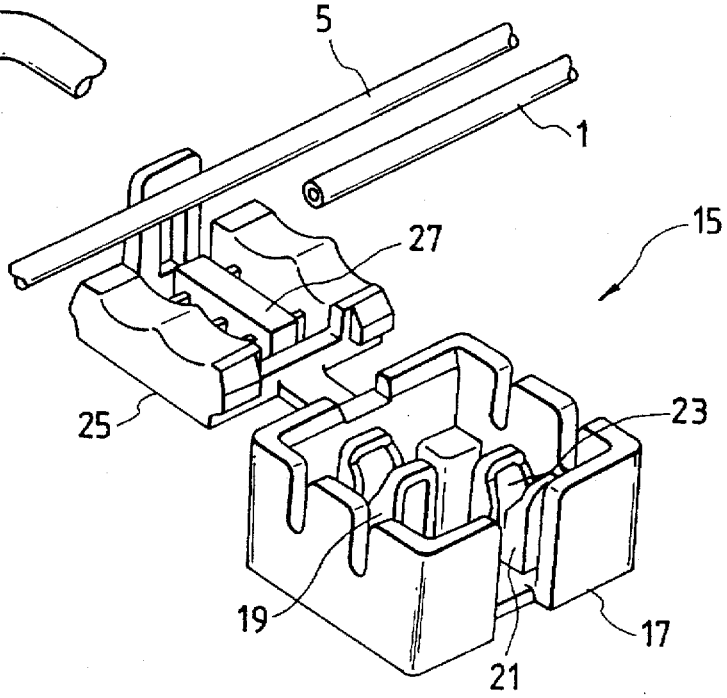
FIG. 8 PRIOR ART
FIG. 8 is a perspective view of a conventional pressure joint connector.
Figure 7:
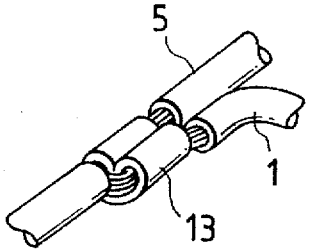
FIG. 7 PRIOR ART
FIG. 7 is a perspective view showing a crimped joint portion.
Figure 9:
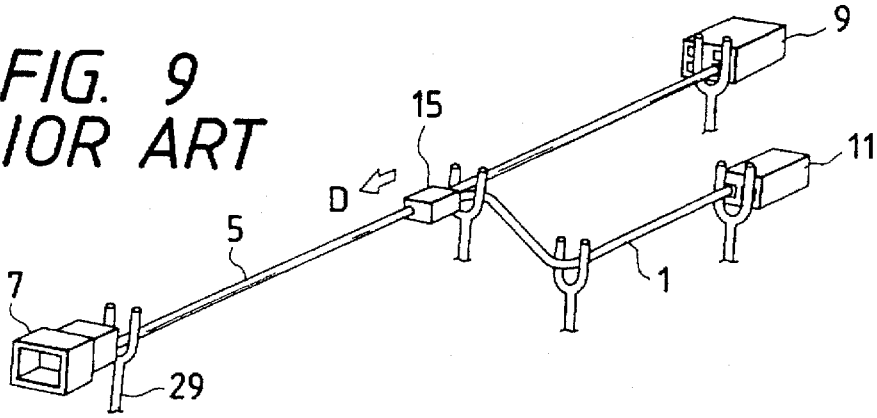
FIG. 9 PRIOR ART
FIG. 9 is a diagram illustrative of a method of assembling the conventional joint connector using U-shaped jigs.

Then, the pressure joint connector 31 and the branch line 45 are pulled in a direction indicated by an arrow D so that the pressure joint connector 31 can be rested on U-shaped jigs 85 and 87. As a result, the branch line 45 has a dimension B (see FIG. 5) defined without having to take a joint positioning dimension C (see FIG. 5), the dimension B extending from the connector 73 at one end of the trunk line 43 to the connector 81 of the branch line 45. When the secondary cover 61 is closed under this condition, the trunk line 43 and the branch line 45 establish electrical conduction through the pressure blades 69 that are integrally disposed, in turn fixing the joint portion and completing the assembling of the wire harness.

Such an assembling method is advantageous not only when the joint position can be set arbitrarily but also even if the branch line 45 is cut too long. That is, the dimension B can be always given by sliding the pressure joint connector 31 further in the direction D until the branch line 45 is stretched. As a result, the assembled dimension B can always be set constant without improving the accuracy of the cutting length of the branch line 45.

Therefore, when the pressure joint connector 31 according to this embodiment is used, the jointing operation can be completed only by moving the U-shaped jigs and closing the secondary cover 61 without having to take the joint positioning dimension nor holding lines during the jointing operation.

The aforementioned pressure joint connector 31 is characterized as including not only the primary cover 51 that fixes the end portion of the branch line 45 and allows the pressure joint connector 31 itself to be held so as to be slidable along the trunk line 43, but also the secondary cover 61 that simultaneously connects the trunk line 43 and the branch line 45 arranged within the housing 33 by pressure, the covers 51 and 61 being arranged on the housing 33. As a result of this construction, no processes and jigs dedicated to positioning and pressuring for jointing the trunk line 43 to the branch line 45 are required, in turn allowing the jointing operation to be performed with ease and with high accuracy by sliding the pressure joint connector 31 along the wire harness assembling jigs.

While an example in which the end portion of the branch line 45 is fixed to the pressure joint connector 31 has been described in the aforementioned embodiment, the branch line 45 may, of course, be jointed in such a manner that the branch line 45 is connected to the trunk line 43 through the pressure joint connector 31 at a position along the lines.

Further, the use of the pressure joint connector 31 according to this embodiment is advantageous in manufacturing wire harnesses having different dimensions B in the case where a wire harness having a different dimension B must be connected to the trunk line 43 whose dimension A is always set constant without changing the cut length of the branch line 45. That is, the pressure joint connector 31 according to this embodiment allows such a wire harness to be manufactured only by changing the attaching position of the third U-shaped jig (U-shaped jig) 83, and this means that the pressure joint connector 31 according to this embodiment allows wire harnesses having different dimensions B to be manufactured.

As described in the foregoing, the pressure joint connector of the invention is characterized not only as arranging in the housing the primary cover that fixes the branch line and holds the pressure joint connector itself so as to be slidable along the trunk line, but also as providing on the secondary cover the pressure blades that bring the trunk line and the branch line inserted into the housing into pressure contact. Therefore, the jointing operation can be performed by sliding the pressure joint connector on the wire harness assembling jigs with ease and with high dimensional accuracy without requiring any processes and jigs dedicated to the positioning and pressuring for jointing the trunk line and the branch line. As a result, both operability and dimensional accuracy can be improved.

In addition, according to the wire harness assembling method using the pressure joint connector, the dimension from the connector at one end of the trunk line to the connector of the branch line can be defined without having to take the joint positioning dimension by pulling the branch line that is temporarily retained so as to be slidable with respect to the trunk line through the pressure joint connector.

What is claimed is:

1. A pressure joint connector for jointing a trunk line to a branch line, comprising:

a housing for allowing the trunk line and the branch line to be inserted thereinto, said housing having an opening formed thereon for exposing the trunk line and the branch line;

a primary cover, arranged on said housing so as to be freely opened and closed through a hinge portion, for fixing only the branch line and leaving the trunk line unfixed when closed over the opening;

a secondary cover, arranged on said housing so as to be freely opened and closed through a hinge portion, for closing so as to be superimposed on said primary cover already closed over the opening; and a pressure blade, arranged so as to project from said secondary cover, for coming in pressure contact with the trunk line and the branch line simultaneously by passing through said primary cover when said secondary cover is closed so as to be superimposed on said primary cover.

2. The pressure joint connector according to claim 1, wherein a vertical wall of said housing has two line inserting grooves formed therein for allowing the trunk line and the branch line to be inserted into said housing.

3. The pressure joint connector according to claim 1, further comprising a line pressing portion, arranged so as to project from a closed side of said primary cover, for pressing only the branch line in a bent condition so that the branch line is interposed and fixed between said line pressing portion and said housing when said primary cover is closed over the opening.

4. The pressure joint connector according to claim 1, wherein said primary cover has a through slit formed therein for introducing said pressure blade into said housing when said secondary cover is closed so as to be superimposed on said primary cover.

5. The pressure joint connector according to claim 1, further comprising a support projection, arranged so as to project from a bottom surface of said housing, for supporting the trunk line from below when said pressure blade is force-fit into the trunk line.

* * * * *